United States Patent [19]

Bluestone

[11] 3,972,325

[45] Aug. 3, 1976

[54] FINGERNAIL PROTECTOR AND METHOD

[75] Inventor: Dianne Bluestone, Los Angeles, Calif.

[73] Assignees: Gene W. Arant; Juanita F. Arant, both of Los Angeles, Calif.

[22] Filed: Aug. 11, 1975

[21] Appl. No.: 603,524

Related U.S. Application Data

[63] Continuation-in-part of Ser. No. 510,229, Sept. 30, 1974, abandoned.

[52] U.S. Cl. ..... 128/132 R; 2/21; 132/73

[51] Int. Cl.[2] ..... A61F 13/00

[58] Field of Search ..... 128/132 R, 153, 77; 132/73; 294/25; 2/21

[56] References Cited

UNITED STATES PATENTS

| | | | |
|---|---|---|---|
| 2,073,867 | 3/1937 | Feigenbaum | 132/73 |
| 2,409,101 | 10/1946 | Brittingham | 2/21 |
| 3,070,804 | 1/1963 | Parrilla | 2/21 |
| 3,228,404 | 1/1966 | Turner | 132/73 |
| 3,487,831 | 1/1970 | Jaume et al. | 128/132 R |

*Primary Examiner*—Lawrence W. Trapp

[57] ABSTRACT

A method of protecting a long protruding fingernail during performance of manual activities by inserting a resilient cushion member within the cavity on the under side of the protruding nail portion and adhesively securing the cushion member to the fingernail.

23 Claims, 26 Drawing Figures

FIG. 16.
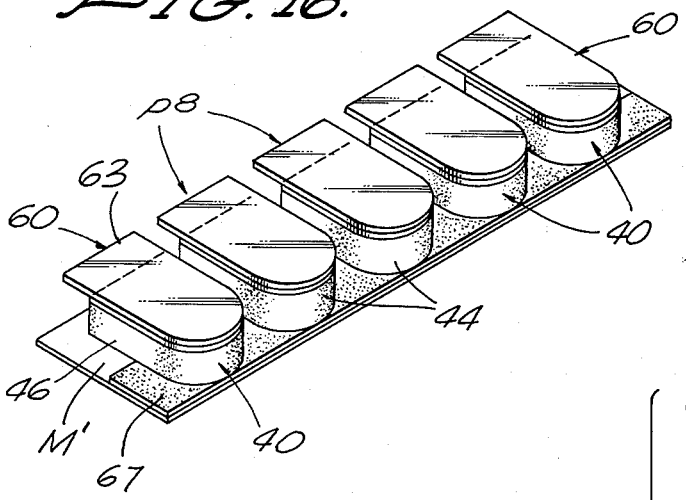
FIG. 18.
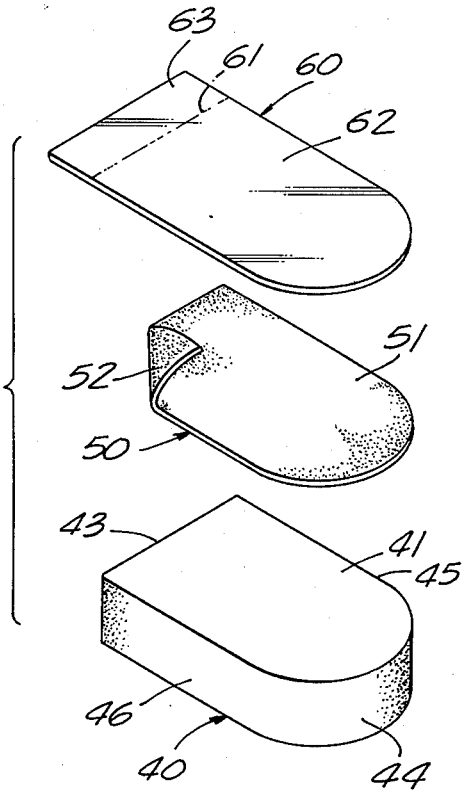
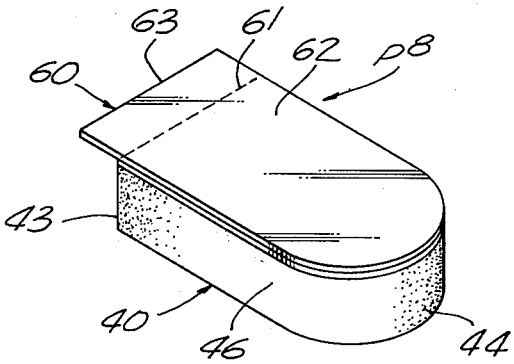
FIG. 17.
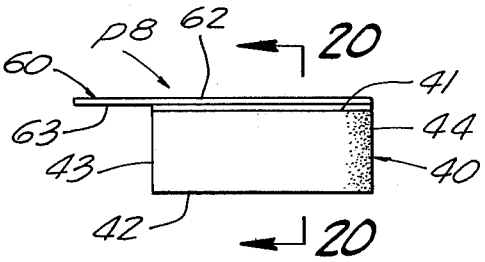
FIG. 19.
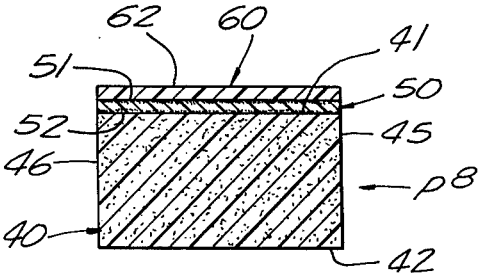
FIG. 20.

FIG. 21.
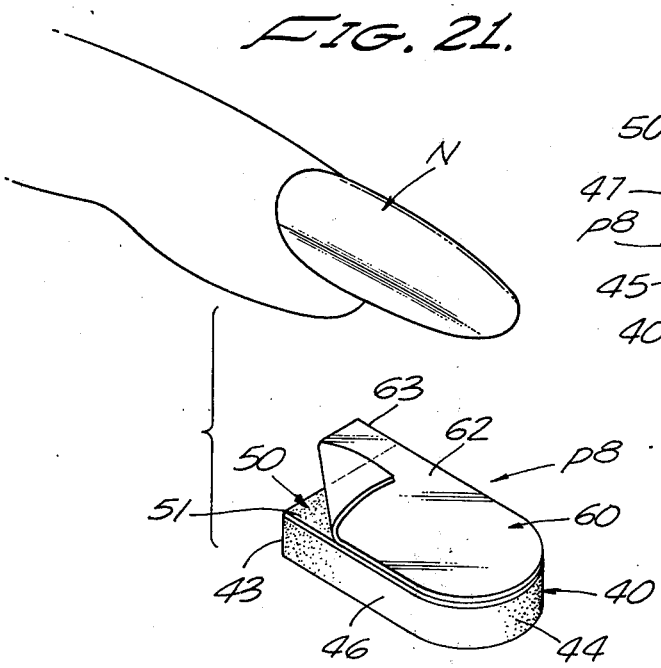
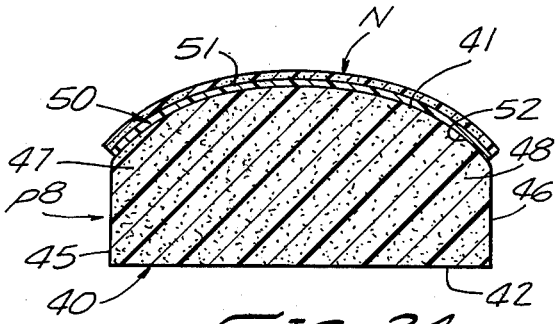
FIG. 24
FIG. 22.
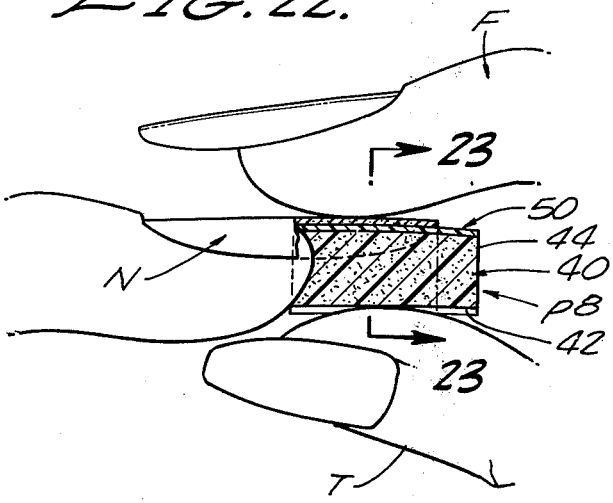
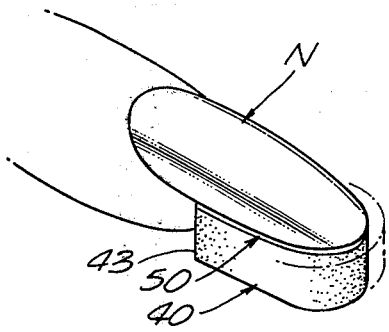
FIG. 25.
FIG. 23.
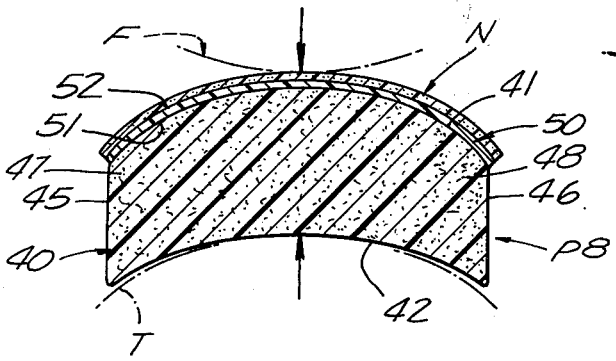
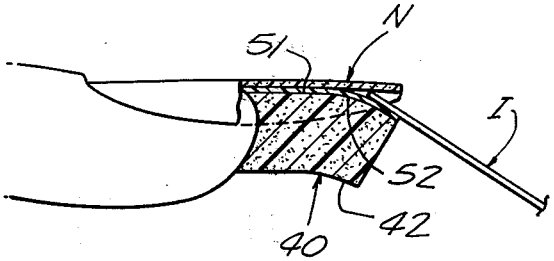
FIG. 26.

FINGERNAIL PROTECTOR AND METHOD

RELATED APPLICATION

This application is a continuation-in-part of my prior copending application Ser. No. 510,229, filed Sept. 30, 1974 and subsequently abandoned.

BACKGROUND OF THE INVENTION

In various parts of the world it is fashionable for ladies to permit their fingernails to grow to a rather extreme length. The long protruding fingernail portions are then painted and decorated to provide an attractive appearance.

Such long fingernails, however, are quite susceptible to being torn or damaged. This is particularly true when the lady finds it necessary to engage in manual work, such as, cooking, housework, tending a flower garden, operating a typewriter, engaging in sports activity or the like.

Ideas have heretofore been advanced for protecting the long fingernails from their top side. According to my invention, however, the long fingernail is protected by inserting a removable cushion into the cavity formed on its under side.

SUMMARY OF THE INVENTION

The invention provides a method of protecting long fingernails in which a resilient cushion is selected having such configuration as to fit the cavity underneath the protruding fingernail portion, and the resilient cushion member is then inserted into the cavity and adhesively secured therein.

The under surface of the protruding portion of a long fingernail is distinctly concave, and the resilient cushion member, when inserted, must conform to the shape of the nail. According to one form of the invention the cushion member is made with a convex shape on its upper surface. A further refinement is to provide an upwardly facing circumferential shoulder on the upper surface, which engages and protects the circumferential edge of the fingernail.

In the presently preferred form of the invention the cushion member is cut from a flat sheet of resilient open-celled foam plastic material having a thickness of the order of 3/8 inch. When the cushion member is inserted into the nail cavity the lateral edges of its upper surface are compressed downwardly to conform to the shape of the fingernail.

In one form of the invention a separate adhesive-bearing sheet is placed on top of the cushion member for securing it to the nail.

According to another form of the invention the resilient cushion member is made of permeable material, and is impregnated with an adhesive, so that adhesive securement of the member is accomplished automatically upon its insertion into the fingernail cavity.

DRAWING SUMMARY

FIG. 16 is a perspective view of a number of fingernail protectors in accordance with the presently preferred form of the invention, when packaged for distribution;

FIG. 17 is a perspective view of a single one of the fingernail protectors of FIG. 16;

FIG. 18 is an exploded perspective view of the protector of FIG. 17;

FIG. 19 is a side elevation view of the protector of FIG. 17;

FIG. 20 is an enlarged cross-sectional view taken on line 20—20 of FIG. 19;

FIG. 21 is a perspective view of the protector of FIG. 17, showing it about to be attached to a long fingernail;

FIG. 22 is a side elevational view, partially in cross-section, showing the securement of the protector to the fingernail;

FIG. 23 is a cross-sectional view taken on line 23—23 of FIG. 22;

FIG. 24 is a cross-sectional view like FIG. 23, but after the attachment of the protector has been completed;

FIG. 25 is a perspective view of the long fingernail with protector attached thereto; and FIG. 26 is a side elevation view, partially in cross-section, illustrating the method of removal of the fingernail protector.

FIRST EMBODIMENT

Figure 1:
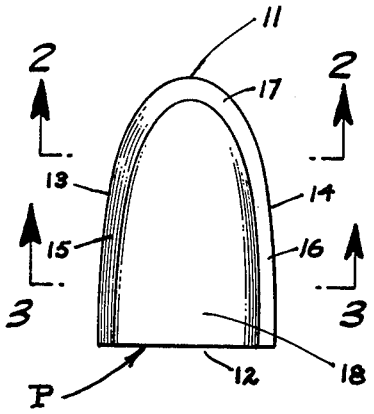
FIG. 1 is a top plan view of a fingernail protector in accordance with the present invention.

Reference is now made to FIGS. 1 through 6, inclusive, illustrating the first embodiment of the invention.

A fingernail protector P is made as a single elongated resilient cushion member. Its rounded forward end is designated by numeral 11 while its relatively square-cut rearward end is designated by numeral 12. The lateral side edges of the cushion member are designated by numerals 13 and 14, respectively. The side edges 13, 14 are rather parallel near the rearward end 12, but they become progressively more curved and then merge into the rounded forward end 11.

The protector P also has an upwardly facing circumferential horizontal shoulder formed thereon, indicated by numerals 15, 16, 17. The shoulder portion 15 is adjacent the side edge 13 while shoulder portion 16 is adjacent side edge 14. The shoulder portion adjacent the rounded forward end 11 is designated as 17.

Figure 2:
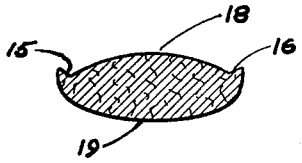
FIG. 2 is a transverse cross-sectional view taken on the line 2—2 of FIG. 1.
Figure 3:
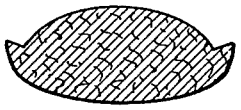
FIG. 3 is a transverse cross-sectional view taken on line 3—3 of FIG. 1.

The upper surface 18 of protector P extends between the inner edges of the shoulders 15, 16 and is transversely curved upwardly as best seen in FIGS. 2 and 3. The under surface 19 extends between the lateral edges 13, 14 and is transversely convexly curved downwardly.

Protector P is made of resilient and permeable material, such as cotton batting or an open-celled plastic material. It is preferably impregnated with an adhesive, such as one of the commercially available types of adhesive material used for dentures. The insertion of the cushion member into the cavity underneath the protruding fingernail portion therefore automatically results in securement of the cushion member to the finger or the nail or both.

Figure 4:
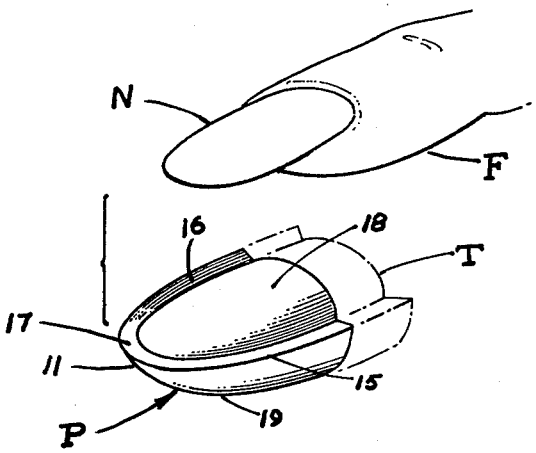
FIG. 4 is a exploded perspective view illustrating the fitting of the protector to the fingernail.
Figure 5:
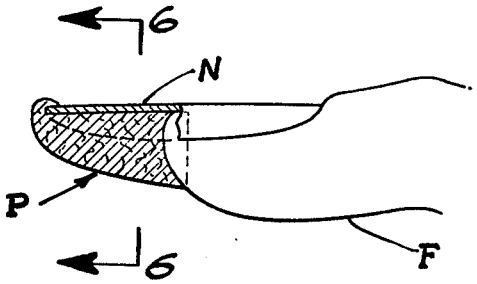
FIG. 5 is an elevational view, partially in cross-section, showing the fingernail protector in use.
Figure 6:
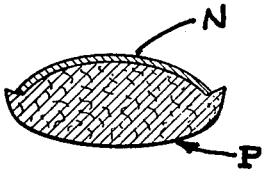
FIG. 6 is a transverse cross-sectional view taken on the line 6—6 of FIG. 5.

It is preferred to manufacture the protector P in a longer length than would generally be needed by the user. The rearward end 12 is then trimmed off to obtain the desired length. The fitting of the protector P is shown in FIG. 4 where it is seen that a portion T, shown in the dotted lines, may be cut off from the protector P as initially provided. The remaining portion of protector P then butts against the end of finger F and fills the cavity beneath the protruding nail N. The operative position of the protector is shown in FIGS. 5 and 6.

The preferred width of the horizontal shoulder 15, 16 is of the order of 1/16 inch, but may if desired be one-eighth inch or greater.

It will be noted that the convex upward curvature of the upper surface 18 of protector P is relatively flat near its forward end, as shown in FIG. 2, but toward its rearward end the upward curvature is significantly sharper as shown in FIG. 3.

The mode of construction of protector P is such that it is quite inexpensive and may therefore be disposed of after a single usage.

As an alternate feature, as shown in FIG. 5, the forward shoulder 17' may be turned up over the fingernail end.

ALTERNATE FORMS

Figure 7:
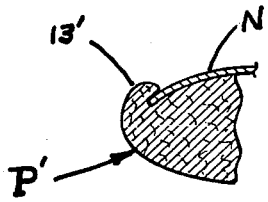
FIG. 7 is a fragmentary cross-sectional view of a modified form of the invention.

FIG. 7 illustrates an alternate form P' of the fingernail protector in which the lateral edge portion 13' is turned upward and inward so that rather than a flat horizontal shoulder for receiving the lateral edge of the nail N there is a small groove in the protector which receives and holds the fingernail edge.

Figure 8:
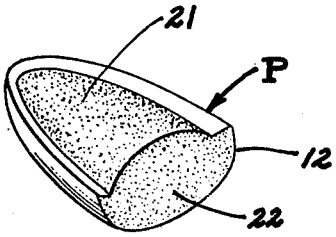
FIG. 8 is a perspective view of another alternate form of the invention.

FIG. 8 illustrates a form P'' of the protector which is not initially impregnated with any kind of adhesive material. The upper surface 18 of the protector is daubed with an adhesive covering 21, and the rearward end 12 is daubed with an adhesive area 22, in order to secure the protector to both the finger and the under surface of the fingernail.

Figure 9:
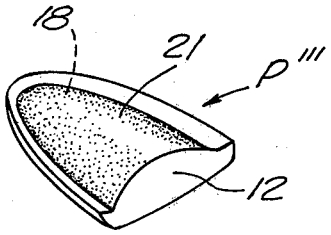
FIG. 9 is a perspective view of still another alternate form.

FIG. 9 illustrates a protector P''' which is similar to protector P'' of FIG. 8, with an adhesive covering 21 daubed on the upper surface 18, but no adhesive on the rearward end 12. Reliance for adhesive securement to the fingernail is placed solely on the upper surface of the protector, and the rearward end is not adhesively secured to the finger of the user, irrespective of whether the rearward end has to be trimmed off to achieve the appropriate length of the protector.

Figure 10:
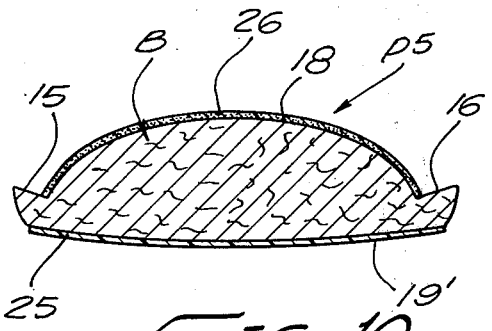
FIG. 10 is a cross-sectional elevational view of yet a different form of the invention.

FIG. 10 illustrates a protector $P^5$ in accordance with the invention. The cushion body B has a bottom surface 19' which is substantially flat, with a very small amount of downwardly convex curvature therein. Lateral shoulders 15, 16 have a rather small vertical thickness.

A water-impervious sealing member 25 is secured to bottom surface 19' of body B. A cloth or fibrous member 26 which is impregnated with adhesive material is secured to the curved upper surface of the body B. The cushion body B is not itself impregnated with adhesive material. The protector is secured to the fingernail by adhesive securement of member 26 to the under surface of the nail.

Figure 11:
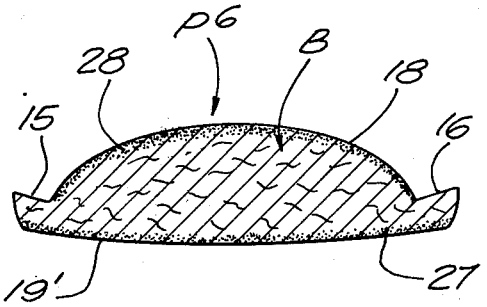
FIG. 11 is a modified version of the protector of FIG. 10.

FIG. 11 illustrates a protector $P^6$ in accordance with the invention. The mechanical configuration of the main body portion B of the protector is the same as in the embodiment of FIG. 10. A liquid or semi-liquid sealing material 27 has been applied to the bottom surface 19' and has penetrated or permeated a short distance into the resilient material of the protector body. A liquid or semi-liquid adhesive material 28 has been applied to the upper surface 18 and has permeated or penetrated a short distance into the upper portion of the protector body. Adhesive material 28 is effective for securing the protector to the under surface of the fingernail of the user.

Figure 12:
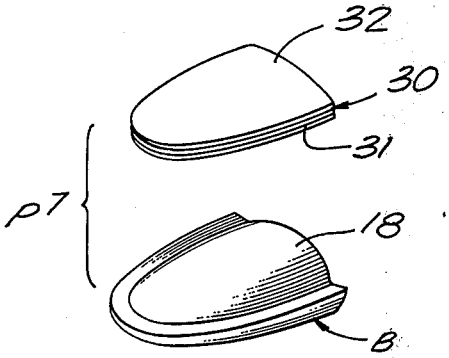
FIG. 12 is an exploded perspective view of a multilayer protector.
Figure 13:
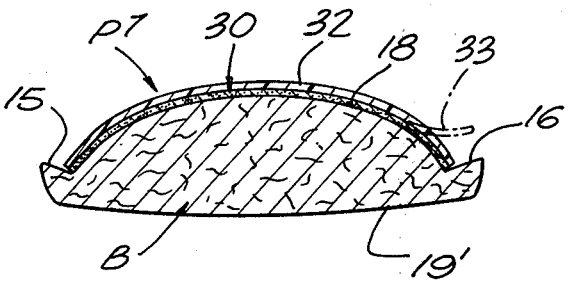
FIG. 13 is a cross-sectional elevational view of the protector of FIG. 12 in its assembled form.

FIG. 12 and 13 illustrates a protector $P^7$ in accordance with the invention. The mechanical configuration of the protector body is the same as in FIGS. 10 and 11. A sheet of pressure-sensitive adhesive material 30 has a removable lower protective cover 31 and a removable upper protective cover 32. The multi-layer package consisting of the adhesive member 30 and its removable covers 31, 32 is trimmed with a rounded end so as to conform generally to the configuration of the upper surface 18 of the protector cushion body. The removable lower cover 31 is detached from the adhesive member 30, whose under surface is then placed in engagement with the upper surface 18 of the protector body. Adhesive member 30 has adhesive coatings on both its upper and lower faces and therefore adheres tightly to the upper surface 18 of the resilient cushion body. The upper protective cover 32 remains in place as the product is distributed to the customer. Before using the protector $P^7$ the customer removes the upper protective cover 32, as indicated by dotted lines 33 in FIG. 13.

Figure 14:
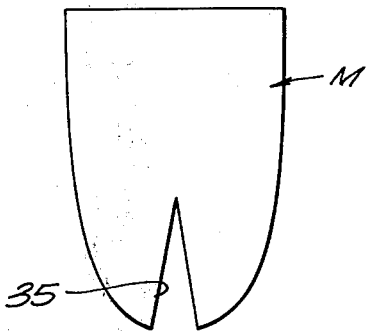
FIG. 14 illustrates a modification of the protector of FIGS. 12 and 13.

FIG. 14 illustrates a modification of the protector $P^7$. The multi-layer adhesive package consisting of the adhesive member 30, removable cover 31, and removable cover 32, is collectively identified by reference character M. After the forward end of the assembly M is rounded off, a V-shaped notch 35 is cut therein. This permits the adhesive member 30, when applied to the convexly curved upper surface 19 of the protector cushion body, to bend longitudinally as well as transversely in order to accommodate itself closely to the shape of the surface 18.

Figure 15:
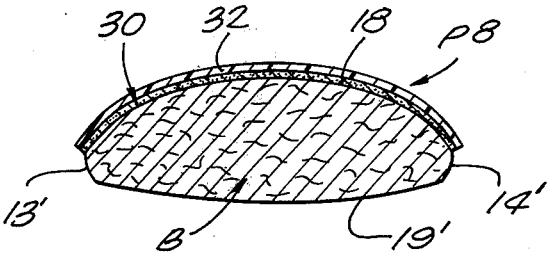
FIG. 15 is a cross-sectional elevational view of a still different embodiment of the invention.

FIG. 15 illustrates still another protector $P^8$ in accordance with the invention. The physical structure is the same as shown in FIG. 13 except that the circumferential edge portions of the cushion body which provide the shoulders 15, 16 are deleted. Thus, the body B is relatively flat on its under surface 19' with a slight downward convex curvature. The lateral edges 13', 14' are rounded somewhat. Adhesive member 30 is secured to the transversely convex upper surface 18. Protective member 32 overlies the adhesive member 30. The use of the embodiment of FIG. 15 is the same as in the previous embodiments, except that the protector does not engage the extreme lateral edges of the fingernail.

Another method of practicing the invention, not specificially shown in the drawings, is for the user to apply a liquid adhesive underneath the fingernail. It is then not necessary to apply adhesive to the cushion member as part of the manufacturing process.

PREFERRED EMBODIMENT

The preferred embodiment of the invention is illustrated in FIGS. 16 through 26, inclusive.

The fingernail protector $P^8$ is shown in FIG. 17 and its component parts are shown in FIG. 18. Protector $P^8$ includes a cushion member 40, an adhesively coated flexible sheet member 50, and a protective cover sheet 60. Each of these component parts will be described in detail.

First, however, it will be pointed out that for purpose of commercial sale the protector $P^8$ is made in about nine or more different sizes. Such size differences make provision for large, medium, and small customers; and also for the differences in size and shape between thumb, middle finger, and the small finger or "pinky." When typical dimensions are given in the ensuing description, therefore, they are only very approximate.

The resilient cushion member 40 has a flat upper surface 41 and a flat lower surface 42, these surfaces being made rather precisely parallel, partly for manufacturing reasons. The vertical thickness of cushion 40 between its surfaces 41, 42 is approximately three-eighths inch. Cushion member 40 has a rearward end 43 which is cut to a generally square configuration, and a precisely square configuration of the rearward end appears to be the most convenient and economical for manufacturing purposes, while a slight concave shape would be somewhat more advantageous to the customer.

The forward end 44 of the cushion member 40 is rounded in the horizontal plane. Cushion member 40 also has lateral side surfaces which are preferably cut quite straight and on vertical planes, the left side surface 45 not being directly visible in FIGS. 17 and 18 which the right side surface 46 is clearly visible.

The resilient cushion member 40 is preferably made from an open-celled foam plastic material of commercial grade which may in chemical terms be a polyolefin material or a polyethylene material, for example. The material is preferably characterized by a rather high degree of resilience and springiness, being not very stiff but of sufficient stiffness to maintain its shape when not subjected to pressure, and having rather high degree of memory so that it will recover its original configuration after being subjected to pressure, when the pressure has been removed.

Flexible sheet member 50 is cut to the same dimensions in the horizontal plane as the cushion member 40. It has an adhesively coated upper surface 51 and an adhesively coated under surface 52. The adhesive material on both surfaces is preferably of the pressure-sensitive type.

Protective cover sheet 60 is of the conventional type used with pressure-sensitive adhesive materials, i.e., it is highly flexible so that it can easily be peeled off, its surface is substantially non-binding, as for example polyethylene, so that the adhesive material will not adhere strongly thereto, but yet there is sufficient adherence between the adhesive material and the surface of cover sheet 60 so that the cover sheet will remain securely in place unless it is intentionally removed.

In FIG. 18 a dotted line 61 indicates the location where the rearward ends of cushion member 40 and sheet member 50 will lie beneath the protective cover sheet 60. That portion 62 of the cover sheet 60 which lies forward of the imaginary line 61 has the same size and shape in the horizontal plane as do the cushion member 40 and the sheet member 50. The portion 63 protruding to the rearward of the imaginary line 61, is the finger tab portion that is used for removing cover 60 when its removal is desired.

The protector $P^8$ is shown in its assembled form in FIGS. 17, 19, and 20. It is assembled by placing flexible sheet member 50 upon the cushion member 40 so that the under surface of the sheet member is adhesively secured to the upper surface of the cushion member. Then cover sheet 60 is placed upon the sheet member 50 so as to cover the adhesive coating 51 thereof. Finger tab portion 63 protrudes as shown.

The preferred method of manufacture is as follows. A flat sheet of resilient, open-celled foam plastic material is selected which has a thickness of approximately three-eighths of an inch. Adhesive material is then applied on the top surface of the entire sheet. This is preferably done by placing thereon a flexible sheet member which is co-extensive with the foam plastic sheet, and has both its surfaces coated with a pressure-sensitive adhesive material. A protective cover sheet is then placed along one edge of the foam plastic sheet, covering a sufficient portion thereof to form a number of protectors $P^8$ and also having a lateral edge which projects outwardly to provide the finger tabs 63. A plurality of protectors $P^8$ are then formed by cutting, along lines perpendicular to the plane of the foam plastic sheet, the entire assembly including the foam plastic sheet, adhesive-bearing sheet, and protective cover sheet.

As will be evident from the illustrations, each protector is about the width and about the length of the protruding portion of a long fingernail N. However, in FIGS. 22, 25, and 26 the thickness of cushion member 40 has been shown somewhat greater than it really is relative to the size of the finger and the size of the fingernail, for purpose of more graphic illustration.

The product is conveniently packaged for distribution in the form shown in FIG. 16. A mounting board M′ has part of its top surface covered by an adhesive strip 67. A number of protectors $P^8$ are arranged with their longitudinal axes perpendicular to the longitudinal axis of the mounting board, and are placed in engagement with the upper surface of the board so that the under surface 42 of each protector will adhere to the adhesive strip 67.

The method of use of the invention is shown in FIGS. 21 through 26, inclusive. As shown in FIG. 21 protector $P^8$ is placed beneath the protruding nail N and cover sheet 60 is removed. Then, as shown in FIG. 22, the lady uses the forefinger F and thumb T of her opposite hand for purpose of inserting the protector within the nail cavity. Forefinger F is placed on top of the protruding nail portion. Thumb T is placed in supporting engagement with the under surface 42 of the protector. The thumb then pushes up, as shown in FIG. 23, and the lateral edges of the upper surface 41 of cushion member 40 then bend downwardly so that the shape of the upper surface of the protector will conform to the shape of the under surface of the nail. Flexible sheet 50 bends in the same manner.

When the protector has been adhesively secured to the nail, the thumb pressure is removed. The under surface 42 of cushion member 40 returns to a substantially flat shape, as shown in FIG. 24. However, the upper lateral edge portions 47, 48 of the cushion member remain in compression.

The protector may be removed as shown in FIG. 26, by inserting an instrument I beneath the forward tip of nail N and above the cover sheet 60. Typically, the instrument used is a fingernail file.

Protector $P^8$ may be used on several occasions before it is advisable to throw them away. Each time they are inserted and then removed in the manner shown.

When operating a typewriter, for example, the flat configuration of under surface 42 as shown in FIG. 24 is a great advantage to the user of the present invention. Typing proceeds at maximum speed, and the long fingernails are fully protected.

Cushion member 40 has substantial memory, for returning to its original position, but after extended use of the protector may become rather compacted. It may then be preferred to dispose of the protectors and replace them with new ones.

It has heretofore been a known practice to use a temporary paper coating for strengthening long fingernails. The protector of the present invention may, if desired, be used in addition to such coating. If nail polish is applied to the under surface of the nail, or to a paper coating thereon, removal of the protectors of the present invention leaves less residual adhesive material.

The invention has been described in considerable detail in order to comply with the patent laws by providing a full public disclosure of at least one or more of its forms. However, such detailed description is not intended in any way to limit the broad scope of patent monopoly to be granted.

What is claimed is:

1. The method of protecting a long protruding fingernail during performance of manual activities by selecting a resilient cushion member adapted to fit within the cavity on the under side of the protruding nail portion, inserting said cushion member within said cavity, and adhesively securing the upper surface of the cushion member to the under surface of the fingernail.

2. The method of claim 1 wherein adhesive material is applied to the upper surface of the cushion member prior to inserting same within the cavity.

3. The method of claim 1 wherein the upper surface of the cushion member is shaped to a laterally convex configuration prior to inserting same within the cavity.

4. The method of claim 1 wherein the cushion member is selected as a portion of a flat sheet of resilient material having a uniform vertical thickness, and upon its insertion into the cavity the lateral edges of its upper surface are bent downwardly.

5. The method of claim 1 wherein the cushion member is selected to be longer than the cavity, and after its insertion its protruding end portion is trimmed off.

6. The method of claim 2 wherein the upper surface of the cushion member is shaped to a laterally convex configuration prior to inserting same within the cavity.

7. The method of claim 2 wherein the cushion member is selected as a portion of a flat sheet of resilient material having a uniform vertical thickness, and upon its insertion into the cavity the lateral edges of its upper surface are bent downwardly.

8. The method of claim 2 wherein adhesive material is applied to the under surface of the fingernail before the cushion is inserted within the cavity.

9. The method of claim 2 wherein the cushion member is impregnated with an adhesive material in a partially liquid state.

10. The method of claim 2 wherein a flexible sheet having adhesive coatings on both of its surfaces is placed upon the upper surface of the cushion member.

11. The method of protecting a long protruding fingernail during performance of manual activities, comprising the steps of:

a. selecting a resilient cushion member which is about the size of the cavity beneath the protruding nail portion;
b. shaping the upper surface of the cushion member to a laterally convex configuration;
c. applying adhesive material to the upper surface of the cushion member;
d. subsequently inserting said cushion member within said cavity; and
e. pressing the cushion member upwardly against the under side of the protruding nail portion so as to firmly secure the upper surface of the cushion member to the under surface of the fingernail.

12. The method of protecting a long protruding fingernail during performance of manual activities, comprising the steps of:

a. selecting a portion of a flat sheet of resilient cushioning material having a uniform vertical thickness of the order of three-eighths inch, so as to provide a cushion member which is about the width and length of the cavity on the under side of the protruding nail portion;
b. applying adhesive material to the upper surface of said cushion member;
c. inserting said cushion member within said cavity; and
d. pressing said cushion member upwardly against the under side of the protruding nail portion so as to bend the upper surface of the cushion member to conform to the configuration of the under surface of the fingernail and concurrently adhesively secure said cushion member to the fingernail.

13. The method of claim 12 wherein said adhesive material is applied to the upper surface of the cushion member by first selecting a thin sheet of flexible material having a coating of pressure-sensitive adhesive on both surfaces thereof, and placing one adhesively coated surface of said sheet member in engagement with the upper surface of the cushion member.

14. The method of protecting a long protruding fingernail during performance of manual activities, comprising the steps of:

a. selecting a resilient cushion member adapted to fit within the cavity on the under side of the protruding nail portion, and having horizontal shoulder portions formed thereon for engaging the lateral edges of the protruding nail portion;
b. inserting said cushion member within said cavity; and
c. adhesively securing the upper surface of the cushion member to the under surface of the fingernail.

15. The method of claim 14 wherein adhesive material is applied to the upper surface of the cushion member prior to its insertion within the cavity.

16. A fingernail protector for removable insertion into the cavity of a long protruding fingernail, said protector comprising:

a resilient cushion member having a forward end which is rounded in the horizontal plane, the upper surface of said cushion member being transversely convexly upwardly curved; and adhesive means on the upper surface of said cushion member;

whereby said cushion member may be inserted into the under-nail cavity and adhesively secured to the under surface of the nail.

17. The fingernail protector of claim 16 wherein said cushion member is made of a permeable material and said adhesive means is provided by an at least partially liquid material which impregnates the upper portion of said cushion member.

18. The fingernail protector of claim 16 which further includes a sheet member of pressure-sensitive adhesive material disposed upon and adhesively secured to the upper surface of said cushion member, and a protective cover sheet removably disposed upon the upper surface of said adhesive sheet member.

19. The fingernail protector of claim 16 wherein said cushion member has horizontal shoulder portions formed thereon for engaging the lateral edges of the fingernail.

20. A fingernail protector for use during performance of manual activities, for protecting a long protruding fingernail from its under side, comprising:

a resilient cushion member having substantially flat, parallel upper and lower surfaces and having a vertical thickness between said surfaces of the order of three-eights of an inch, said cushion member having a generally square rearward end, a rounded forward end, being about the width of the protruding nail portion, and having a length about as great as that of the protruding nail portion;

pressure-sensitive adhesive means on the upper surface of said cushion member; and a removable cover sheet on said adhesive means;

whereby when said cover sheet is removed, and said cushion member is inserted within the cavity on the under side of the protruding nail portion and is pressed upwardly against the under side of the protruding nail portion, the lateral edges of the upper portion of said cushion member are downwardly compressed and said adhesive means firmly but removably secures the protector to the under surface of the fingernail.

21. The protector of claim 20 wherein said cushion member is made of an open-celled foam plastic material.

22. The protector of claim 20 wherein said cover sheet extends rearwardly from said cushion member, to facilitate removal thereof.

23. The protector of claim 20 which includes a flexible sheet member having both surfaces thereof adhesively coated, one surface engaging and being adhesively secured to the upper surface of said cushion member, and the other surface thereof being adapted for engagement with the fingernail.

* * * * *